US007132800B2

(12) United States Patent
Van Esveld et al.

(10) Patent No.: US 7,132,800 B2
(45) Date of Patent: Nov. 7, 2006

(54) HIGH-PRESSURE DISCHARGE LAMP

(75) Inventors: Hendrik Anton Van Esveld, Eindhoven (NL); Johan Leopold Victorina Hendrix, Eindhoven (NL); Gerardus Marinus Josephus Franciscus Luijks, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 42 days.

(21) Appl. No.: 10/495,287

(22) PCT Filed: Nov. 5, 2002

(86) PCT No.: PCT/IB02/04662

§ 371 (c)(1),
(2), (4) Date: May 12, 2004

(87) PCT Pub. No.: WO03/043054

PCT Pub. Date: May 22, 2003

(65) Prior Publication Data

US 2005/0012464 A1 Jan. 20, 2005

(30) Foreign Application Priority Data

Nov. 15, 2001 (EP) ..... 01204360

(51) Int. Cl.

| | |
|---|---|
| ***H01J 13/46*** | (2006.01) |
| ***H01J 17/34*** | (2006.01) |
| ***H01J 19/78*** | (2006.01) |
| ***H01J 23/16*** | (2006.01) |
| ***H01J 29/96*** | (2006.01) |
| ***H01J 7/44*** | (2006.01) |
| ***H01J 1/62*** | (2006.01) |
| *H01K 1/50* | (2006.01) |

(52) U.S. Cl. ..... 315/60; 315/59; 313/578

(58) Field of Classification Search ..... 315/60, 315/59, 71, 58, 50, 52, 53; 313/25, 547, 313/569, 578, 619, 622, 624
See application file for complete search history.

(56) References Cited

U.S. PATENT DOCUMENTS

| | | | | |
|---|---|---|---|---|
| 4,268,780 | A * | 5/1981 | Roche et al. | 315/179 |
| 4,742,275 | A * | 5/1988 | Ito et al. | 315/59 |
| 4,812,714 | A * | 3/1989 | Keeffe et al. | 315/60 |
| 4,987,344 | A * | 1/1991 | Zaslavsky et al. | 315/59 |
| 5,420,479 | A * | 5/1995 | Iida et al. | 315/73 |
| 5,811,933 | A * | 9/1998 | Van Den Nieuwenhuizen et al. | 313/570 |
| 6,194,846 | B1 * | 2/2001 | Van Veldhuizen | 315/309 |
| 6,661,177 | B1 * | 12/2003 | Luijks et al. | 315/60 |

FOREIGN PATENT DOCUMENTS

| | | |
|---|---|---|
| GB | 1596161 | 8/1981 |

* cited by examiner

*Primary Examiner*—Don Wong
*Assistant Examiner*—Marie Antoinette Cabucos

(57) ABSTRACT

A high-pressure discharge lamp has a discharge vessel that is enclosed, with an interspace, by an outer bulb. The end of the outer bulb is provided with a lamp cap. The lamp has an ignition circuit including a series connection of a glow starter and an ohmic impedance. The ohmic impedance is formed by a halogen incandescent lamp. The mutual orientation of the glow starter and the ohmic impedance is such that heat produced by the ohmic impedance is at least partly intercepted by the glow starter.

15 Claims, 2 Drawing Sheets

HIGH-PRESSURE DISCHARGE LAMP

Figure 1:
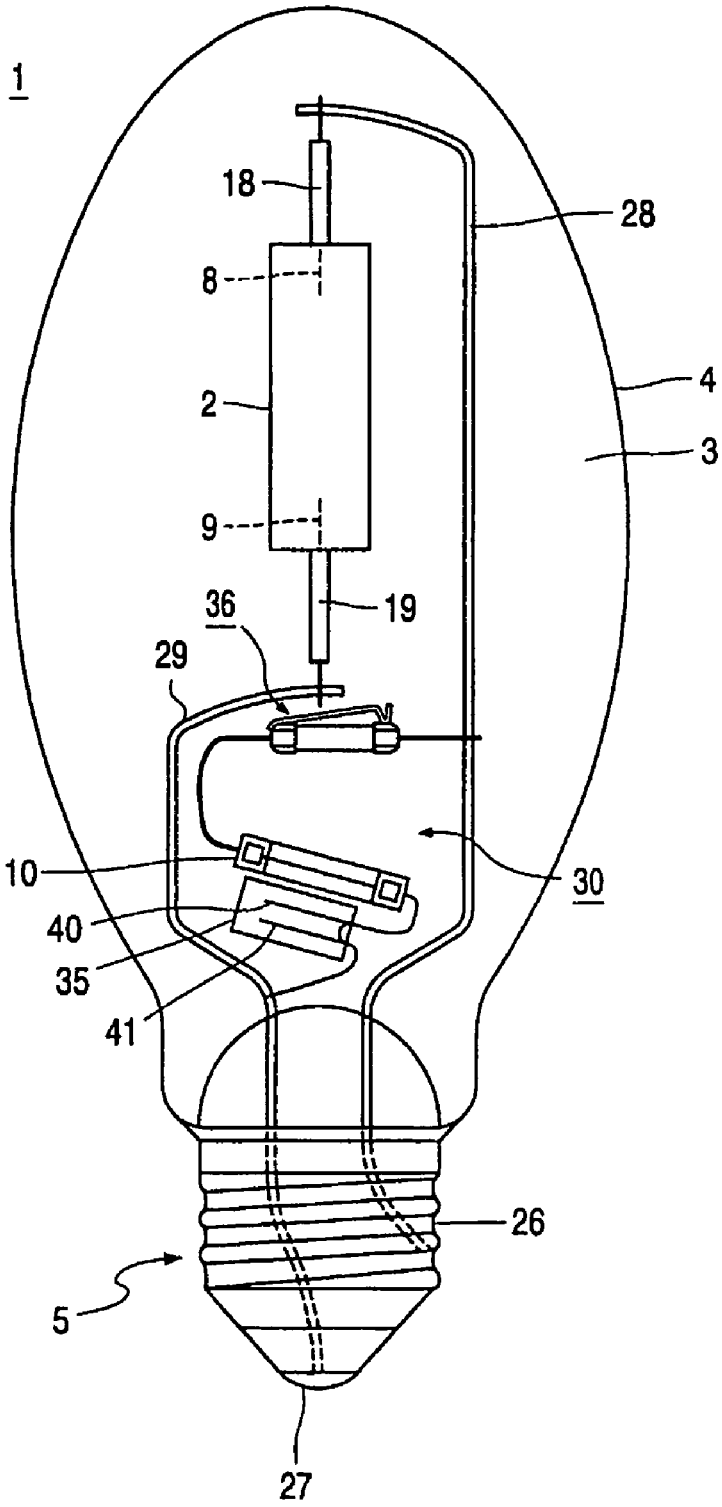

The invention relates to a high-pressure discharge lamp provided with a discharge vessel that is enclosed, with an interspace, by an outer bulb, the end of which is provided with a lamp cap, which lamp also has an ignition circuit comprising a series connection of a glow starter and an ohmic impedance.

A lamp of the type mentioned in the heading is known from GB 1596161. An advantageous aspect of a lamp with a built-in ignition circuit is the possibility that the lamp is in principle suitable as a retrofit lamp for an installation designed for a high-pressure mercury discharge lamp. Modem high-pressure discharge lamps such as, for example, high-pressure sodium lamps and metal halide lamps have a very high ignition voltage and consequently require that the ignition circuit generates a high ignition pulse, for example of a magnitude of at least 2.5 kV. This is easy to realize with a known glow starter. The glow starter is provided with electrodes, which close under the influence of heat development, for example as a result of a glow discharge in the starter itself, which also leads to a short-circuit in the series connection. This results in the occurrence of relatively large currents in the ignition circuit, which are limited as much as possible by means of the ohmic impedance. A related consequence is, however, that the ohmic impedance must be relatively great and that a considerable dissipation takes place in the ohmic impedance. This is disadvantageous and necessitates the use of special high-power ohmic impedances, which raises the cost and is thus disadvantageous.

Another disadvantage of the known lamp is that, if it fails to ignite, the ignition circuit keeps generating ignition pulses for a long time, accompanied by a continuous load on the ohmic impedance and generation of EMI signals, which may lead to unsafe situations.

The invention has for its object to provide a means for counteracting the disadvantages described. To achieve this object, a lamp of the type mentioned in the heading is characterized according to the invention in that the ohmic impedance is formed by a halogen incandescent lamp. Since an incandescent filament, for example in the form of an incandescent coil, of an incandescent lamp is meant to assume a high temperature, and since it is also included in a bulb filled with halogen, the incandescent lamp is adequately resistant to a relatively long and relatively great dissipation of the incandescent body. The large-scale use of halogen incandescent lamps for lighting purposes over a wide power range also has the advantage that there is a large variety of such lamps, so that is easy for an expert to find a suitable halogen incandescent lamp, at a relatively low price, for use in the ignition circuit of the lamp according to the invention. Surprisingly, it has been found that the halogen incandescent lamp can also function as a UV-enhancer. The use of a UV-enhancer has a very favorable effect on a fast and reliable ignition of the high-pressure discharge lamp. This is especially favorable for metal halide lamps, whose ignition behavior is strongly influenced by the presence of free electrons. Such a metal halide lamp should preferably be provided with a discharge vessel with a ceramic wall. The advantage of this construction is that a favorable ignition behavior is combined with very good photometric properties, such as a high luminous flux and stable color properties.

Preferably, the series connection also comprises a bimetal switch that is closed in the cold condition. The advantage of this is that the series connection can be switched off electrically as soon as the lamp is ignited, for example under the influence of the heat generated by the discharge. Another advantage is that, after extinction of the lamp and reconnection of the supply voltage, ignition pulses will not be generated until the bimetal switch has cooled to such an extent that it has closed. This prevents un unnecessary load on the ignition circuit.

The mutual orientation of the glow starter and the halogen incandescent lamp should preferably be such that the heat produced by the halogen incandescent lamp is at least partly intercepted by the glow starter. The halogen incandescent lamp produces heat during ignition of the high-pressure discharge lamp. A suitable mutual orientation of the incandescent lamp and the glow starter, the two lying next to each other, causes a substantial part of the heat produced by the incandescent lamp to be supplied to the glow starter. A continuous supply of heat to the glow starter will lead to closure of the electrodes after a time interval has elapsed. The advantage of this is that the further heat development in the halogen incandescent lamp keeps the electrodes of the glow starter closed, so that any further generation of ignition pulses is blocked.

A good heat transfer from the halogen incandescent lamp to the glow starter can be realized in particular if the spacing between the two is limited. In practice, it proves to be advantageous when the distance between a housing of the incandescent lamp and the glow starter is no more than 6 cm, preferably 2 cm or smaller. It is also preferable that the halogen incandescent lamp and the glow starter are placed mainly parallel to each other. This improves the efficiency of the heat transfer to the glow starter. However, effective results are also obtained when an incandescent lamp and a glow starter are positioned transversely to each other. Preferably, the incandescent lamp and the glow starter are positioned in such a way that the electrodes of the glow starter close after a burning time of the halogen incandescent lamp of between 15 and approximately 40 seconds.

Figure 2:
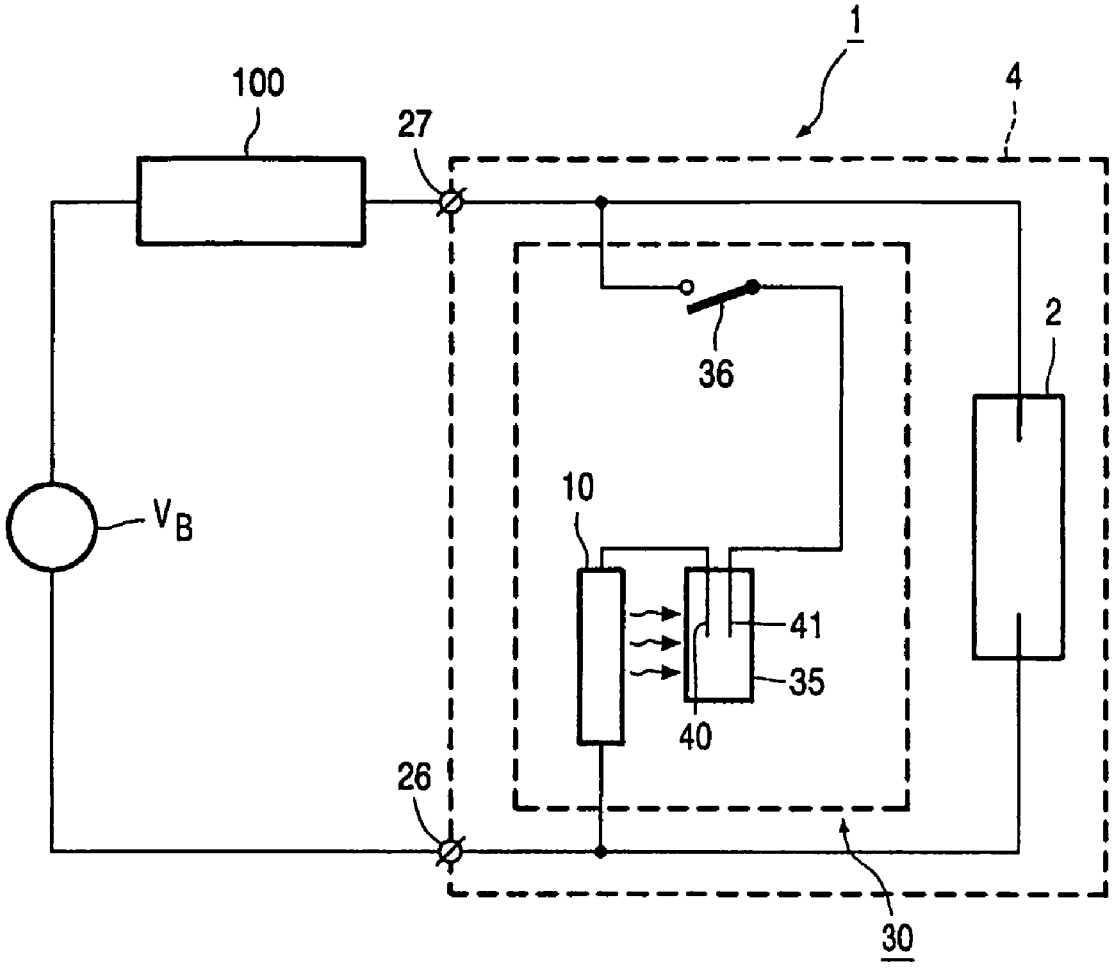

The above-mentioned and other aspects of the invention will be explained in more detail below with reference to a drawing, in which FIG. 1 shows a lamp according to the invention, and FIG. 2 is a circuit diagram of the lamp of FIG. 1.

In FIG. 1, 1 is a high-pressure discharge lamp provided with a discharge vessel 2, enclosed with an interspace 3 by an outer bulb 4, the end of which is provided with a lamp cap 5, which lamp is also provided with an ignition circuit 30, comprising a series connection of a glow starter 35, an ohmic impedance 10 in the form of a halogen incandescent lamp, and a bimetal switch 36. The glow starter is provided with electrodes 40, 41 which close under the influence of heat generation, for example as a result of a glow discharge in the starter itself, which also leads to a short-circuit in the series connection.

Both ends of the discharge vessel 2 are provided with a projecting plug 18, 19, which contain a feed-through between internal electrodes 8, 9 and lead wires 28, 29. The lead wires are electrically connected to electric contacts 26, 27 of the lamp cap 5.

In FIG. 2, the lamp 1 is connected by its electric contacts 26, 27 and via a stabilization ballast 100 to a power source VB in a manner usual per se. The series connection of the ignition circuit 30 is constructed in such a way that the orientation between the glow starter 35 and the incandescent lamp 10 is such that the heat produced by the incandescent lamp 10 is at least partly intercepted by the glow starter 35. The supply of heat to the glow starter 35 under the influence of the halogen incandescent lamp will lead to a closure of the electrodes 40, 41 of the glow starter 35 after a time interval has elapsed. The orientation of the series connection is also such that the bimetal switch 36 is placed at such a large distance from the incandescent lamp 10 that no heat or only a very limited amount of heat will reach the bimetal switch 36, so that the correct functioning of the bimetal switch will not be affected.

In a practical realization of a lamp according to the invention, the lamp is a high-pressure sodium lamp with a rated wattage of 400 W. The lamp is connected via a ballast of the type BUS 400L 33, make Philips, to a power source of 220V, 50 Hz. In another realization, the lamp is a metal halide lamp with a rated wattage of 400 W. The discharge vessel of the lamp has a ceramic wall. The filling of the discharge vessel consists of Hg and Na, as well as iodides of Tl, Dy, Ca, Ho, and Tm, and Xe as a starting gas. The lamp is suitable for operation on a power source via a ballast of the type MH 400 W CWA 71 A6091. The ballast can be connected to a 60 Hz power source with a voltage of between 120V and 277V, and supplies a voltage of 135V to its lamp connections.

The halogen incandescent lamp that is part of the ignition circuit integrated in the lamp is a 230V, 150 W type halogen-a lamp, make Philips. The halogen incandescent lamp has a quartz glass housing. This gives the lamp an excellent heat resistance. The advantage of this is that there is a great degree of freedom as regards the location of the halogen incandescent lamp in the outer bulb. The glow starter, for example of the known type retrolux, make Philips, and the halogen incandescent lamp are located in such a way that the distance between the housing of the incandescent lamp and the glow starter is no more than 6 cm, preferably 2 cm or smaller.

During ignition and operation of the practical lamp, the maximum value of the inrush current through the ignition circuit is found to be 5.8 A. The average short-circuit current through the ignition circuit, on the other hand, is 0.73 A. If the halogen incandescent lamp and the glow starter are located substantially parallel to each other with a spacing of 2 cm, the electrodes of the glow starter will close if the lamp does not ignite within 20 seconds, so that any further generation of ignition pulses is blocked. The time needed for closing the electrodes of the glow starter increases, under otherwise unchanging conditions, to just above 40 s if the spacing is 6 cm In a further practical realization, the lamp is a metal halide lamp suitable for operation on a ballast of the type MH 175 W CWA 71A5590, make Advance Transformer. The incandescent lamp as part of the ignition circuit is of the same type as in the previous example. The maximum current through the series connection is 4 A in the present example, and the average short-circuit current through the ignition circuit is 0.69 A.

In both practical realizations, the ignition pulse generated is more than 2.5 kV.

The ignition circuit described is also subjected to a switching life test, in which the supply voltage is alternately switched on for 5 s and switched off for 35 s. After 2000 switching operations, the ignition pulse generated is still >2.5 kV.

In another test, the lamp is ignited during and after a long time in the dark. This did not reveal any notable delay in ignition.

The invention claimed is:

1. A high-pressure discharge lamp comprising:

a discharge vessel that is enclosed, with an interspace, by an outer bulb, an end of said outer bulb being provided with a lamp cap; and an ignition circuit comprising a series connection of a glow starter and an ohmic impedance, wherein the ohmic impedance is formed by a halogen incandescent lamp, and the mutual orientation of the glow starter and the halogen incandescent lamp is such that heat produced by the halogen incandescent lamp is at least partly intercepted by the glow starter.

2. The high-pressure discharge lamp as claimed in claim 1, wherein the halogen incandescent lamp and the glow starter are placed substantially parallel to each other.

3. The high-pressure discharge lamp as claimed in claim 1, wherein a spacing between a housing of the incandescent lamp and the glow starter is no more than 6 cm, preferably 2 cm or smaller.

4. The high-pressure discharge lamp as claimed in claim 1, wherein the incandescent lamp and the glow starter are positioned in such a way that electrodes of the glow starter close after a burning time of the halogen incandescent lamp of between 15 and 40 seconds.

5. The high-pressure discharge lamp of claim 1, wherein the lamp is a metal halide lamp.

6. The high-pressure discharge lamp of claim 1, wherein the discharge vessel has a ceramic wall.

7. The high-pressure discharge lamp of claim 1, wherein the series connection comprises a bimetal switch that is closed in a cold condition.

8. A discharge lamp comprising:

an envelope;

a discharge vessel located in said envelope and having at least one electrode configured for ignition; and an ignition device configured for providing said ignition, said ignition device comprising a series connection of a glow starter and an ohmic impedance;

wherein a mutual orientation of said glow starter and said ohmic impedance is such that heat produced by said ohmic impedance is at least partly intercepted by said glow starter.

9. The discharge lamp of claim 8, wherein said ohmic impedance is formed by a halogen incandescent lamp.

10. The discharge lamp of claim 8, wherein said ohmic impedance and the glow starter are placed substantially parallel to each other.

11. The discharge lamp of claim 8, wherein said lamp is a metal halide lamp.

12. The discharge lamp of claim 8, wherein said discharge vessel has a ceramic wall.

13. The discharge lamp of claim 8, wherein said series connection comprises a bimetal switch that is closed in a cold condition.

14. The discharge lamp of claim 8, wherein a spacing between said ohmic impedance and said glow starter is no more than 6 cm.

15. The discharge lamp of claim 8, wherein said ohmic impedance and said glow starter are positioned in such a way that electrodes of the glow starter close after a burning time of said ohmic impedance of between 15 and 40 seconds.

* * * * *